United States Patent [19]

Radimer

[11] 4,127,456

[45] Nov. 28, 1978

[54] POLARIZER FOR THE ELECTROLYTIC PRODUCTION OF PEROXYDISULFATES

[75] Inventor: Kenneth J. Radimer, Little Falls, N.J.

[73] Assignee: FMC Corporation, Philadelphia, Pa.

[21] Appl. No.: 753,757

[22] Filed: Dec. 23, 1976

[51] Int. Cl.[2] ..... C25B 1/28

[52] U.S. Cl. ..... 204/82; 204/DIG. 2

[58] Field of Search ..... 204/82, 93, DIG. 2

[56] References Cited

U.S. PATENT DOCUMENTS

| | | | |
|---|---|---|---|
| 1,059,809 | 4/1913 | Adolph et al. | 204/82 |
| 2,589,982 | 3/1952 | Wood et al. | 204/82 |
| 3,915,816 | 10/1975 | Rossberger | 204/82 |

FOREIGN PATENT DOCUMENTS

| | | |
|---|---|---|
| 796,778 | 10/1968 | Canada. |
| 108,777 | 10/1974 | German Democratic Rep. |
| 110,246 | 12/1974 | German Democratic Rep. |

OTHER PUBLICATIONS

Chemical Abstract 82: 117869z, 1975.
Chemical Abstract 78: 143097h.
Chemical Abstract 80: 33175r.
Chemical Abstract 80: 103107w.
Chemical Abstract 82: 20071v, 1975.
Chemical Abstract 84: 128065b.

*Primary Examiner*—T. Tung
*Attorney, Agent, or Firm*—Charles C. Fellows; Frank Ianno

[57] ABSTRACT

A process for the direct electrolytic preparation of sodium or ammonium peroxydisulfate with high current efficiencies in which the polarizer is glycine. Glycine can be used as a polarizer in either batch or continuous cyclic electrolysis processes. The glycine is used in concentrations of from about 0.004 weight percent up to about 0.5 weight percent.

2 Claims, 1 Drawing Figure

EFFECT OF .04% GLYCINE IN AMMONIA PERSULFATE

POLARIZER FOR THE ELECTROLYTIC PRODUCTION OF PEROXYDISULFATES

Figure 1:
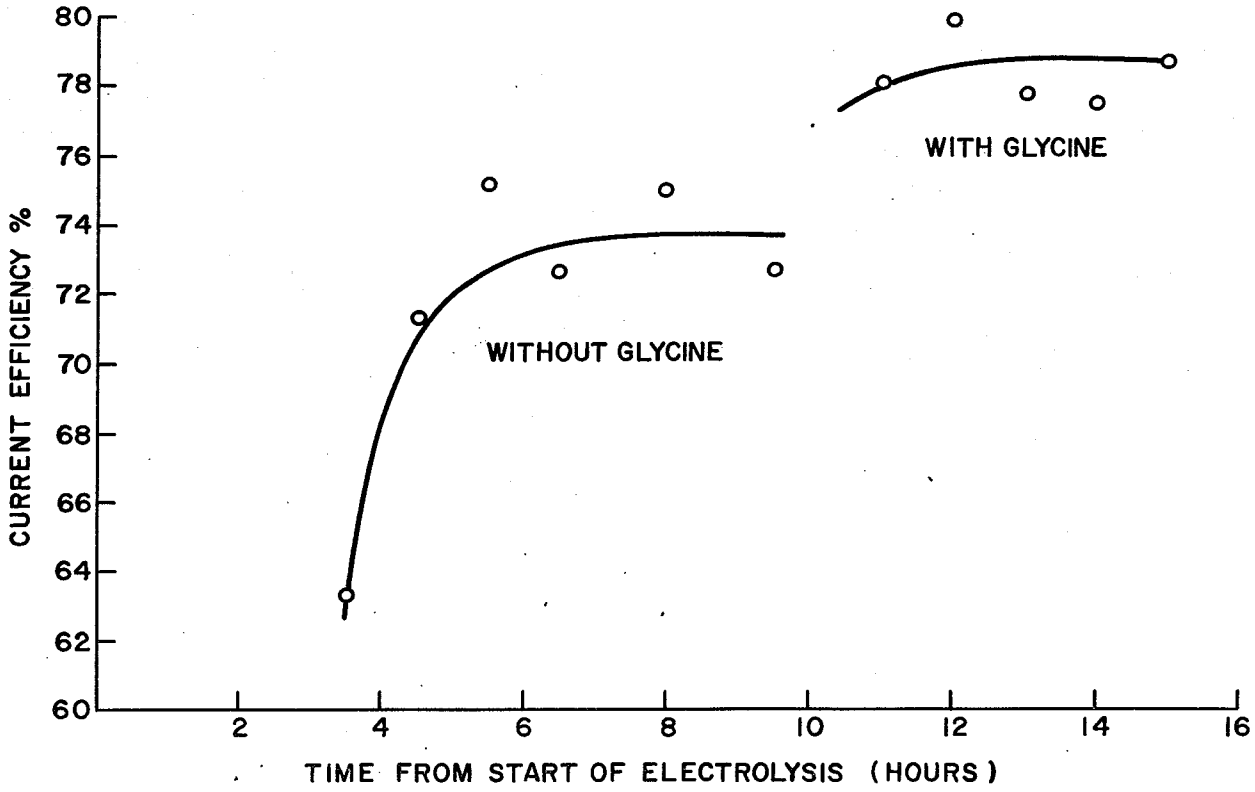

This invention relates to a novel polarizer for use in the electrolytic production of sodium peroxydisulfate and ammonium peroxydisulfate.

Salts of peroxydisulfuric acid, particularly ammonium peroxydisulfate and sodium peroxydisulfate are chemicals which have been found particularly useful by the printed circuit industry as the best available materials for cleaning copper before plating and soldering operations. Ammonium peroxydisulfate, also commonly termed ammonium persulfate, is easily produced by electrolytic processes. Recently, there have been disclosures of electrolytic processes for the direct production of sodium peroxydisulfate.

Ammonium and sodium persulfate are prepared by direct electrolysis employing aqueous sulfate solutions and sulfuric acid as feed or starting solutions. The use of polarizers has long been known in acidic sulfate electrolytes containing either sodium or ammonium cations to improve current efficiency.

The feed anolyte in an electrolytic cell must generally contain a polarizer to provide ions such as cyanide, thiocyanate, cyanate, fluoride, ferrocyanide, ferricyanide, chloride or perchlorate ions. Cyananmide, urea and thiourea are useful polarizers. Generally, the best polarizers have been ammonium thiocyanate and cyananmide. When the cyanide type of polarizer is employed, these polarizers produce very small concentrations of cyanides in the anode product solutions. This cyanide may be stripped from the exit anolytes so that it can be concentrated and destroyed. However, it would be desirable to have a polarizer which does not produce these objectionable cyanide concentrations in the anode product solutions.

In accordance with the present invention, there is provided a process for the direct electrolytic preparation of sodium or ammonium peroxydisulfate with high current efficiencies in which the polarizer is glycine. The glycine can be used as a polarizer in either batch or continuous cyclic electrolysis processes. The glycine is used in concentrations of from about 0.002 weight percent up to about 0.6 weight percent. Higher concentrations can be used, but they have little additional effect in improving the current efficiency of the electrolysis and are economically not advisable.

The following examples are provided to further illustrate this invention. Proportions in the examples and throughout the specification are by weight and the temperatures are in degrees centigrade, unless otherwise indicated.

SINGLE CELL EXAMPLES

BATCH OPERATION

An electrolytic cell made of clear polymethyl methacryate plastic was used in these examples.

The anode and cathode compartments of the cells were separated by porous alundum diaphragm material which was sealed in place using a silicone rubber caulking compound. Each compartment was provided with a glass tubing cooler, through which cooled water was circulated. Agitation was provided by introducing air through sintered glass spargers to stir the electrolytes. The volumes of the anode and cathode compartments were adjusted as needed by insertion of inert plastic blocks.

The anode assembly consisted of platinum gauze 6.6 cm. by 5.7 cm. and the area of the platinum was 17.6 sq. cm. Facing the 37.62 sq. cm. platinum gauze anode, and on the other side of the diaphragm, was a lead cathode with an area of 42.8 sq. cm. on the side of the lead facing the anode, not including the area of the portion of the lead cathode sheet used as a lead-in strip. The anode and cathode assemblies were positioned on opposite sides of the diaphragm and about 0.5 cm. from the diaphragm. Direct current for cell operation was obtained from a variable rectifier.

The initial anolyte composition in the examples was 24.0 weight percent sodium sulfate ($Na_2SO_4$), 1.167 weight percent $(NH_4)_2SO_4$, 11.95 weight percent $(NH_4)_2S_2O_8$ and with the polarizer percentage indicated in Table I.

The effects of the polarizers on current efficiencies are shown in Table I. Comparative examples are indicated by letters A, B, and C. The example of the invention is referred to as Run No. 1. Batch cell current efficiencies were measured for the first hour of electrolysis and instantaneous current efficiencies were determined at the points where they became equal numerically to the conversions (the fraction of the anolyte's sulfur in the form of persulfate). These crossover percentages are useful for comparing batch cell results with each other.

EXAMPLE II

CONTINUOUS MULTIPLE CELL ELECTROLYSIS (8 cell cascade)

Eight cells were designed and made as described above. The anodes, cathodes, method of cooling and agitation and method of adjusting the volumes of each cell were as described in Example I. The eight cells are connected in a series so that the electrolytes can flow from cell to cell by gravity, in a cascade arrangement. After the eight cell cascade was completely assembled, with each cell containing two platinum gauze anodes connected together electrically outside each cell, the porous alundum diaphragm cemented in place with a silicone rubber seal, a single two millimeter lead cathode with 65 sq. cm. of surface facing the anodes (excluding the area of an inch-wide tail of the cathode used as a lead-in) and with glass coolers, spargers and a thermometer, the volume of each anode and cathode compartment was measured. With a zero flow through the cascade, the average volume per anode compartment was 243 ml. and the average volume in each cathode compartment was 258 ml. A large volume of the feed anolyte was prepared containing 21.66% $Na_2S_2O_8$, 13.20% $Na_2SO_4$ and 9.50% $(NH_4)_2SO_4$ and stored in a 30 gallon polyethylene drum from which it was gravity fed through the cascade cell arrangement. After passing through the first of the eight cascade cells, the anolyte and catholyte streams overflowed by gravity into the second cell and, thus, eventually emerged from the eighth cell. The voltage on the eight cell cascade was 46.2 volts. The current through each cell was 13.8 amps. The anolyte feed rate was 33.7 ml./min. The specific gravity of the sulfuric acid catholyte feed was 1.318 and the catholyte feed rate was 9.12 ml./min. The cathode product rate was 10.0 ml./min. and the cathode product specific gravity was 1.267. The minicascade current efficiencies for the various polarizers tested are set forth in Table II.

The data in Tables I and II show that glycine is a moderately good polarizer and it is interesting because it does not produce cyanide in definitely detectable concentrations in any of the anolytes in which it was used, even when used at the 0.4 percent concentration. Glycine does not appear quite as effective in the batch cell examples as in the minicascade. Surprisingly, other amino acids tested, B-alanine and gelatin, were not effective polarizers.

EXAMPLE III

The usefulness of glycine as a polarizer in the electrolytic production of ammonium persulfate was evaluated using the eight cell cascade described in Example II.

In an extended experiment, glycine was added at the rate of 0.871 ml./min. of a 19.28 g glycine per liter of water solution into a 34 ml./min. stream containing 26.61% $(NH_4)_2SO_4$ and 19.68% $(NH_4)_2S_2O_8$ the mixture then entering the first anode compartment of the first cell of the eight cell cascade. The cathode compartment of the first cell of the eight cell cascade was fed with 8.60 ml./min. of 45.29% $H_2SO_4$. Current densities were the same as in Example II, 13.8 amperes passing through each two-coupon anode. The anolyte temperature was kept at 30° ± 1° C. Current efficiencies were determined by means of active oxygen assays on the feed and product anolytes. A comparison experiment was run feeding water to the first anolyte compartment in place of the glycine solution; otherwise the comparison experiment was the same as the described experiment.

The results of the experiment and the comparison are shown in FIG. I which is a plot of the current efficiencies obtained during the course of the experiments. The current efficiency at the end of the glycine-free comparison electrolysis was 70.03% and the current efficiency at the end of the example of the invention using glycine as the polarizer was 77.38%.

If a cascade of cells is used to produce persulfate, the feed anolyte may contain only neutral salts such as sodium and/or ammonium sulfates and possibly also persulfates. Alternatively, the feed anolyte may contain free $H_2SO_4$ in addition. It is apparent that a polarizer useful with a neutral feed anolyte is also useful with acidic feed anolytes since immediately at the beginning of the electrolysis of even a neutral feed the anolyte becomes acidic, becoming more acidic throughout the course of the electrolysis. The operating anolytes are thus all acidic, whether the feed anolyte is neutral or acidic. This occurs because persulfate cells' anode efficiencies are less than 100%; as a result water is oxidized to oxygen and hydrogen ion is left in the anolyte. The acidity accumulates, and can reach several percent as $H_2SO_4$ before anolytes exit from persulfate cell cascades. In the example given, the cascade's exit anolyte contained 1.25% $H_2SO_4$.

TABLE I

EFFECTS OF POLARIZERS ON CURENT EFFICIENCIES OF ELECTROLYTIC CELLS PRODUCING SODIUM PERSULFATE

| | | | BATCH CELL | |
|---|---|---|---|---|
| RUN | COMPOUND | CONCENTRATION | CROSSOVER | CURRENT EFFICIENCY (0–60 MIN) |
| A | $NH_4SCN$ | .04 | 66.4% | 92.2% |
| B | $Na_4Fe(CN)_6$ | 0.27 | 70.0 | 75.8 |
| C | B-alanine | .0468 | N.C. | 33.3 |
| 1 | Glycine | .0395 | 69.5 | 78.6 |

TABLE II

EFFECTS OF POLARIZERS ON CURRENT EFFICIENCIES OF ELECTROLYTIC CELLS PRODUCING SODIUM PERSULFATE

| RUN | COM-POUND | CONCENTRATION | MINICASCADE CURRENT EFFICIENCY |
|---|---|---|---|
| A | $NH_4SCN$ | .04 | 72 |
| B | $Na_3Fe(CN)_6$ | .027 | 70 |
| C | Gelatin | | Gels |
| 1 | Glycine | .0395 | 67, 70 |
| 2 | Glycine | .394 | 69, 70 |

What is claimed is:

1. In the process for the direct electrolytic production of sodium proxydisulfate or ammonium peroxydisulfate with high current efficiencies in an electrolytic cell having a protected cathode by the direct electrolysis of an aqueous anolyte feed solution in the presence of a polarizer the improvement which comprises the use of glycine as the polarizer.

2. The process of claim 1 in which 0.002 to 0.6 percent by weight glycine is present in the anolyte feed solution.

* * * * *

UNITED STATES PATENT AND TRADEMARK OFFICE

CERTIFICATE OF CORRECTION

PATENT NO. : 4,127,456

DATED : 28 November 1978

INVENTOR(S) : Kenneth J. Radimer

It is certified that error appears in the above-identified patent and that said Letters Patent are hereby corrected as shown below:

Column 4, line 21, "CURENT" should read --CURRENT--; line 28, "0.27" should read --.027--; line 44, "proxydisulfate" should read --peroxydisulfate--.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*